US012617509B2

(12) United States Patent
Bell

(10) Patent No.: US 12,617,509 B2
(45) Date of Patent: May 5, 2026

(54) ANTIFREEZE DELIVERY SYSTEM WITH A CAP ASSEMBLY

(71) Applicant: David Bell, Farmington Hills, MI (US)

(72) Inventor: David Bell, Farmington Hills, MI (US)

( * ) Notice: Subject to any disclaimer, the term of this patent is extended or adjusted under 35 U.S.C. 154(b) by 441 days.

(21) Appl. No.: 18/319,006

(22) Filed: May 17, 2023

(65) Prior Publication Data

US 2024/0383590 A1 Nov. 21, 2024

(51) Int. Cl.

| | |
|---|---|
| ***B63C 15/00*** | (2006.01) |
| ***B63J 99/00*** | (2009.01) |
| ***F01P 3/20*** | (2006.01) |

(52) U.S. Cl.

CPC ..... *B63C 15/00* (2013.01); *B63J 99/00* (2013.01); *F01P 3/205* (2013.01)

(58) Field of Classification Search

CPC .... B63B 2013/005; B63C 15/00; B63J 99/00; F01P 3/205; B63H 20/30

See application file for complete search history.

(56) References Cited

U.S. PATENT DOCUMENTS

2011/0308664 A1* 12/2011 Gregal ..... B63H 21/383 137/15.04

OTHER PUBLICATIONS

Amazon, Perko Sea Strainer Flush Cap, https://www.amazon.com/Perko-Sea-Strainer-Flush-Cap/dp/BOC4X4TFC2?th=1, on sale 2023 (Year: 2023).*

Amazon, Bflush Cap, https://a.co/d/glhl8FV, on sale 2019 (Year: 2019).*

Amazon, Coolant Funnel, https://a.co/d/gH6Epd3, on sale 2022 (Year: 2022).*

Amazon, Perko Sea Strainer, https://a.co/d/6J6f3tV, on sale 2016 (Year: 2016).*

* cited by examiner

*Primary Examiner* — Andrew Polay

(74) *Attorney, Agent, or Firm* — Vivacqua Crane, PLLC

(57) ABSTRACT

An antifreeze delivery system includes a container that defines a chamber for containing a volume of an antifreeze. The system further includes a conduit having an upstream end and a downstream end. The upstream end of the conduit is fluidly connected to the container to receive the volume of the antifreeze from the container. The system further includes a cap assembly that fluidly connects the downstream end of the conduit to an inlet opening defined by a top rim of a sea strainer. The cap assembly includes a lid having a planar wall with top and bottom surfaces. The lid defines a channel extending between the top and bottom surfaces and receiving the downstream end of the conduit. The system further includes one or more fasteners for attaching the lid to the sea strainer and sandwiching a seal between the lid and the top rim of the sea strainer.

6 Claims, 5 Drawing Sheets

ANTIFREEZE DELIVERY SYSTEM WITH A CAP ASSEMBLY

INTRODUCTION

The present disclosure relates to winterizing vehicles, and more particularly to an antifreeze delivery system having a cap assembly for delivering a volume of antifreeze to a hydraulic circuit without spilling antifreeze from the cap assembly.

Watercrafts may include engines and cooling circuits with seawater lines that use seawater to cool the engines. If the watercrafts are not properly maintained by draining the cooling circuit prior to storage during a winter season, salt water or fresh water trapped in certain parts (e.g., heat exchangers, engine blocks, etc.) may freeze and expand into closed spaces, such that those parts may crack and split open. This may damage or destroy those components. In other examples, expanding and frozen fluids can merely cause a hose to blow off its fitting or split open.

Boat owners may winterize their boats by running the engine and using a funnel resting within an opening of a sea strainer to manually pour antifreeze into the sea strainer and fill the cooling circuit. More specifically, the sea strainer may be positioned below deck and upstream of the engine in the cooling circuit. While the boat owner fills the cooling circuit with antifreeze, the boat owner also intermittently monitors the exhaust port. When the boat owners observes that antifreeze is being discharged from the discharge port, the boat owner may determine that the cooling circuit has been filled with antifreeze. The boat owner may then promptly turn off the engine and remove the funnel and antifreeze from the sea strainer. Because the funnel merely rests within the opening and the individual may need to quickly supply the antifreeze, antifreeze may spill from the funnel and onto the sea strainer and into the compartment containing the sea strainer.

Thus, while existing antifreeze delivery systems achieve their intended purpose, there is a need for a new and improved system that addresses these issues.

SUMMARY

According to several aspects of the present disclosure, an antifreeze delivery system includes a container that defines a chamber for containing a volume of antifreeze. The system further includes a conduit having an upstream end and a downstream end, with the upstream end being fluidly connected to the container to receive the volume of antifreeze from the container. The system further includes a cap assembly that fluidly connects the downstream end of the conduit to an inlet opening defined by a top rim of a sea strainer. The cap assembly includes a lid having a planar wall, which includes top and bottom surfaces and a thickness between the top and bottom surfaces. The lid defines a channel extending between the top and bottom surfaces, with the channel receiving the downstream end of the conduit, and the bottom surface defining an annular surface area. The system further includes a seal attached to the annular surface area of the lid. The system further includes one or more fasteners for attaching the lid to the sea strainer, such that the seal is sandwiched between the annular surface portion of the lid and the top rim of the sea strainer and prevents antifreeze from spilling onto the sea strainer.

In one aspect, the fastener includes an elongated shaft having a first end pivotably attached to one of the lid and the sea strainer. The elongated shaft further includes a second end with a threaded fastener. The fastener further includes a nut threadably attached to the threaded fastener of the elongated shaft and engaging the other of the lid and the sea strainer. The fastener attaches the lid to the sea strainer, in response to the nut engaging the other of the lid and the sea strainer.

In another aspect, the fastener includes first and second elongated shafts pivotably attached to an associated one of first and second portions of the sea strainer. The fastener further includes first and second nuts threadably attached to an associated one of the first and second elongated shafts, such that the first and second nuts engage the lid. The fastener attaches the lid to the sea strainer, in response to the first and second nuts attaching to the associated elongated shafts and engaging the lid.

In another aspect, the lid includes first and second abutments extending radially outward from the planar wall, with the first and second nuts engaging an associated one of the first and second abutments of the lid.

In another aspect, each of the first and second abutments has an upper surface that is positioned coplanar with the top surface of the planar wall and a lower surface that is positioned coplanar with the bottom surface of the planar wall.

In another aspect, the first and second abutments are disposed diametrically opposite to one another relative to the planar wall.

In another aspect, the first abutment defines a first peripheral edge. The first abutment further defines a through hole, which is spaced from the first peripheral edge and extending between the upper and lower surfaces.

In another aspect, the second abutment defines a second peripheral edge and an open-ended slot extending between the upper and lower surfaces. The open ended slot further extends radially outward and terminates at the second peripheral edge.

In another aspect, the container is an open-topped vessel having an annular wall defining the chamber. The upstream end of the conduit is fluidly connected to the annular wall of the open-topped vessel via a stop valve, which is movable between an open position and a closed position.

In another aspect, the annular wall terminates at an upper rim, and the container further includes a cover releasably attached to the upper rim.

In another aspect, the cover defines an aperture, and the container further includes a one-way air relief valve attached to the cover and disposed in the aperture, such that air flows through the one-way air relief valve into the chamber in response to the antifreeze being drawn from the chamber and into the upstream end of the conduit.

According to several aspects of the present disclosure, a cap assembly for an antifreeze delivery system that includes a container defining a chamber for containing a volume of an antifreeze. The system further includes a conduit having an upstream end and a downstream end. The upstream end of the conduit is fluidly connected to the container and receives the volume of antifreeze from the container. The cap assembly includes a lid fluidly connecting the downstream end of the conduit to an inlet opening defined by a top rim of a sea strainer. The lid includes a planar wall with top and bottom surfaces and a thickness between the top and bottom surfaces. The lid defines a channel extending between the top and bottom surfaces, with the channel receiving the downstream end of the conduit, and the bottom surface defining an annular surface area. The cap assembly further includes a seal that is attached to the annular surface area of the lid. The cap assembly further includes one or more fasteners for attaching the lid to the sea strainer, such that the seal is sandwiched between the annular surface portion of the lid and the top rim of the sea strainer.

In one aspect, the fastener includes first and second elongated shafts pivotably attached to an associated one of first and second portions of the sea strainer. The fastener further includes first and second nuts, which are threadably attached to an associated one of the first and second elongated shafts and engage the lid. The fastener attaches the lid to the sea strainer, in response to the first and second nuts attached to the associated elongated shafts and engaging the lid.

In another aspect, the lid includes first and second abutments extending radially outward from the planar wall, with the first and second nuts engaging an associated one of the first and second abutments of the lid.

In another aspect, each of the first and second abutments has an upper surface that is positioned coplanar with the top surface of the planar wall and a lower surface that is positioned coplanar with the bottom surface of the planar wall. The first and second abutments are disposed diametrically opposite to one another relative to the planar wall.

In another aspect, the first abutment defines a first peripheral edge. The first abutment further defines a through hole, which extends between the upper and lower surfaces and is spaced from the first peripheral edge. The second abutment defines a second peripheral edge and an open-ended slot, which extends between the upper and lower surfaces. The open-ended slot further extends radially outward and terminates at the second peripheral edge.

In another aspect, the container includes an open-topped vessel having an annular wall defining the chamber. The upstream end of the conduit is fluidly connected to the annular wall of the open-topped vessel via a stop valve, which is movable between an open position and a closed position.

In another aspect, the annular wall terminates at an upper rim. The container further includes a cover, which is releasably attached to the upper rim and defines an aperture. The container further includes a one-way air relief valve that is attached to the cover and disposed in the aperture, such that air flows through the one-way air relief valve into the chamber, in response to the antifreeze being drawn from the chamber and into the upstream end of the conduit.

According to several aspects of the present disclosure, a method is provided for operating a cap assembly of an antifreeze delivery system having a container that defines a chamber for containing a volume of an antifreeze. The system further includes a conduit having an upstream end and a downstream end, with the upstream end being fluidly connected to the container to receive the volume of the antifreeze from the container. The method includes connecting, using one or more fasteners, the lid to the sea strainer. The method further includes sandwiching the seal between an annular surface portion of the lid and a top rim of the sea strainer, in response to the fastener connecting the lid to the sea strainer. The method further includes fluidly connecting, using the lid, the downstream end of the conduit to an inlet opening defined by the top rim of the sea strainer. The lid includes a planar wall having top and bottom surfaces and a thickness between the top and bottom surfaces. The lid defines a channel extending between the top and bottom surfaces, and the channel receives the downstream end of the conduit. The method further includes disposing the container at a position above the sea strainer and pouring a volume of the antifreeze in the container. The method further includes starting a marine engine, which is fluidly connected to the sea strainer and disposed downstream of the sea strainer. The method further includes moving a stop valve from a closed position to an open position, with the stop valve fluidly connecting the upstream end of the conduit to the annular wall of the open-topped vessel. The method further includes flowing the volume of antifreeze from the chamber of the container to the sea strainer. The method further includes flowing the volume of antifreeze from the sea strainer to the marine engine. The method further includes flowing a portion of the volume of antifreeze from the marine engine to an exhaust port, which is fluidly connected to the marine engine and disposed downstream of the marine engine. The method further includes stopping the marine engine, in response to the portion of the volume of antifreeze being discharged from the exhaust port.

In one aspect, the method further includes flowing, using a one-way air valve attached to a cover of the container, air into the chamber of the container, in response to the volume of antifreeze flowing from the chamber of the container to the sea strainer.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
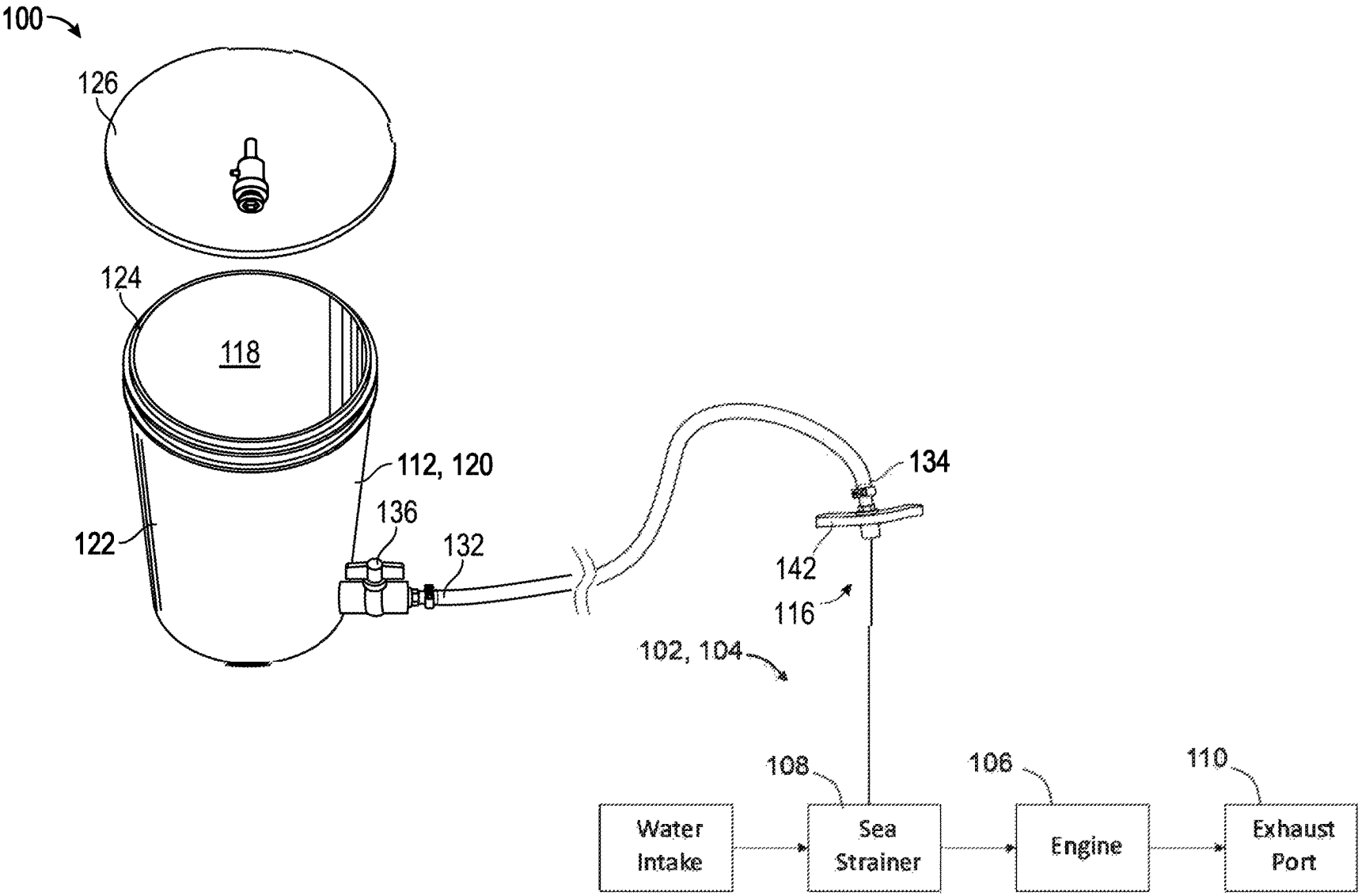
FIG. 1 is a perspective view of one example of an antifreeze delivery system including a container, a conduit fluidly connected to the container, a lid covering the container, and a cap assembly.

The following description is merely exemplary in nature and is not intended to limit the present disclosure, application, or uses.

The present disclosure describes one example of an antifreeze delivery system 100 (system) for delivering a volume of antifreeze to a hydraulic circuit 102. In this non-limiting example, the hydraulic circuit 102 is a cooling circuit 104 for a marine engine 106 of a watercraft, with the cooling circuit 104 including a water intake 105, a sea strainer 108 positioned downstream of the water intake 105, the marine engine 106 positioned downstream of the sea strainer 108, and an exhaust port 110 positioned downstream of the marine engine 106. In other non-limiting examples, the system may deliver antifreeze or other liquid to any other suitable hydraulic circuit or vessel of any vehicle or other system. Non-limiting examples of the vehicle 100 (e.g., an aircraft or a land vehicle, such as a sedan, a light duty truck, a heavy duty truck, a sport utility vehicle, a van, a motor home, a passenger bus, a commercial truck, a waste collection vehicle, a utility vehicle, a delivery vehicle, an emergency vehicle, etc.). As described in detail below, the system 100 includes a container 112 for containing the antifreeze, a conduit 114 fluidly connected to the container 112, and a cap assembly 116 fluidly connecting the conduit 114 to the sea strainer 108, such that antifreeze may flow from the container and through the conduit to the sea strainer 108 without spilling antifreeze where the cap assembly 116 is connected to the sea strainer 108.

Referring to FIG. 1, one non-limiting example of the antifreeze delivery system 100 (system) includes the container 112 with the volume of antifreeze disposed therein. The container 112 defines a chamber 118 for containing the volume of the antifreeze. In this non-limiting example, the container 112 is an open-topped vessel 120 having an annular wall 122 that defines the chamber 118 and terminates at an upper rim 124.

Figure 2:
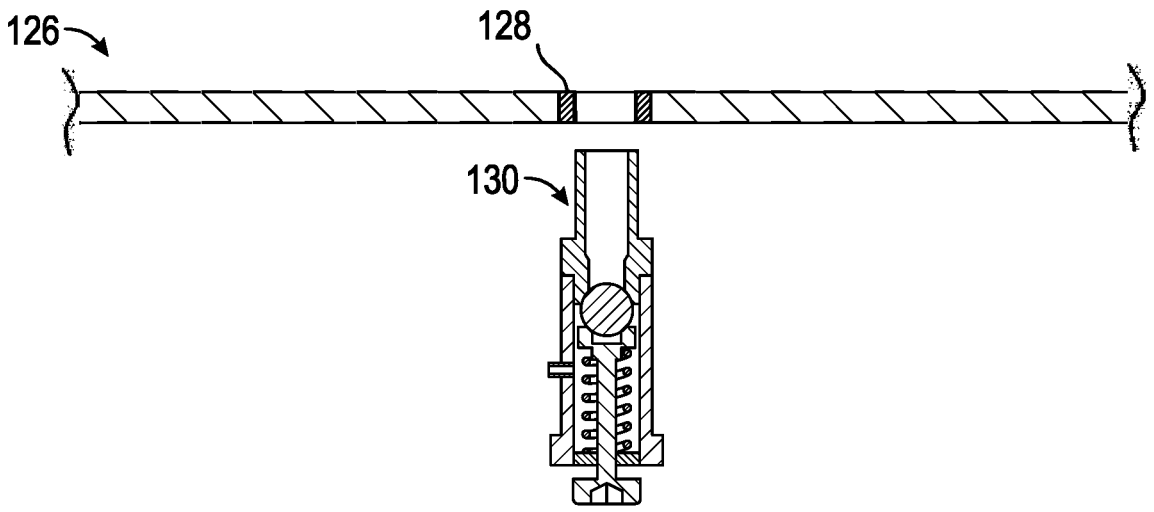
FIG. 2 is an enlarged cross-sectional view of the lid of FIG. 1, illustrating the lid having a one-way air relief valve to draw air into the container when antifreeze flows through the stop valve.

Referring to FIGS. 1 and 2, the container 112 further includes a cover 126 releasably attached to the upper rim 124 of the open-topped vessel 120. The cover 126 defines an aperture 128 (FIG. 2), and the container 112 further includes a one-way air relief valve 130 (FIG. 2) attached to the cover 126 and disposed in the aperture 128, such that air flows through the one-way air relief valve 130 into the chamber 118, in response to the antifreeze being drawn from the chamber 118 and into an upstream end 132 of the conduit 114 as described below. It is contemplated that the vessel can have any suitable shape.

Figure 3:
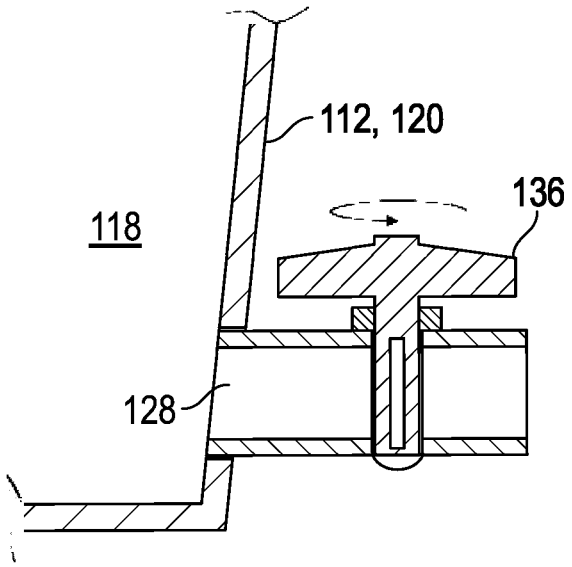
FIG. 3 is an enlarged cross-sectional view of a portion of the container of FIG. 1, illustrating a stop valve fluidly connecting an upstream end of the conduit to the container.

Referring to FIGS. 1 and 3, the conduit 114 includes the upstream end 132 and a downstream end 134, with the upstream end 132 being fluidly connected to the container 112 to receive the volume of the antifreeze from the container 112. The upstream end 132 of the conduit 114 is fluidly connected to the annular wall 122 of the open-topped vessel 120 via a stop valve 136 movable between an open position and a closed position.

Figure 4:
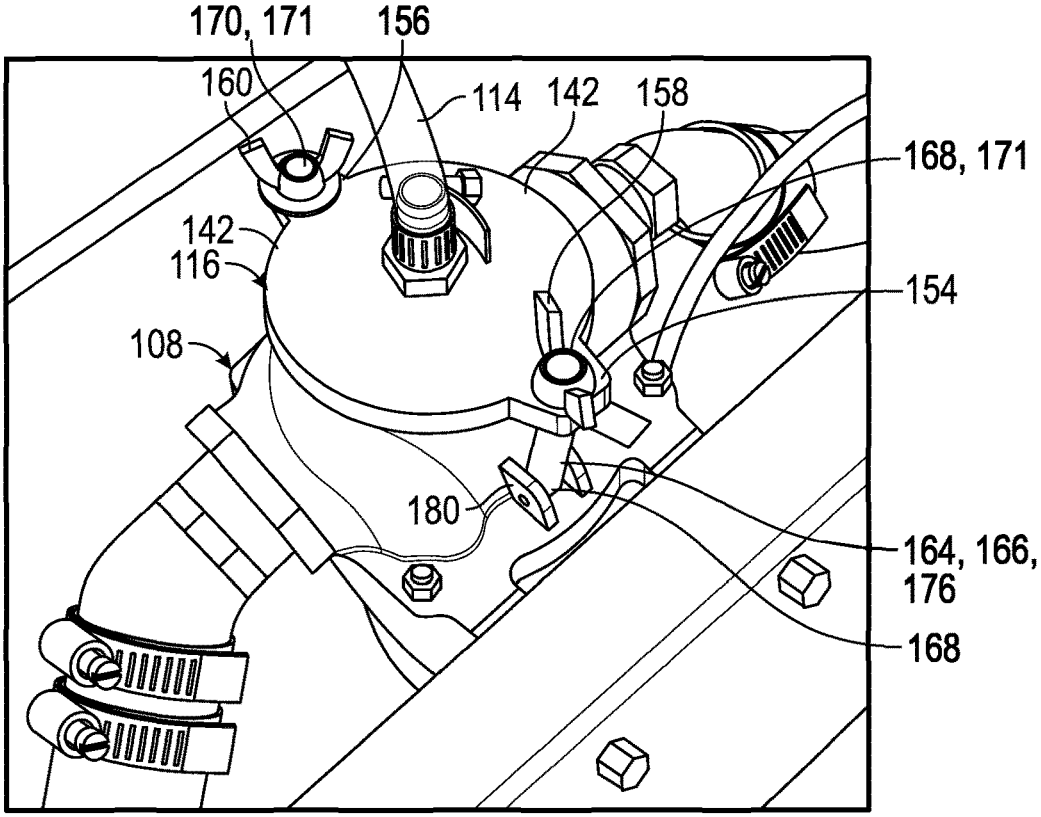
FIG. 4 is an enlarged perspective view of the cap assembly of FIG. 1, illustrating the cap assembly sealing attaching the conduit to a sea strainer upstream of a marine engine.
Figure 5:
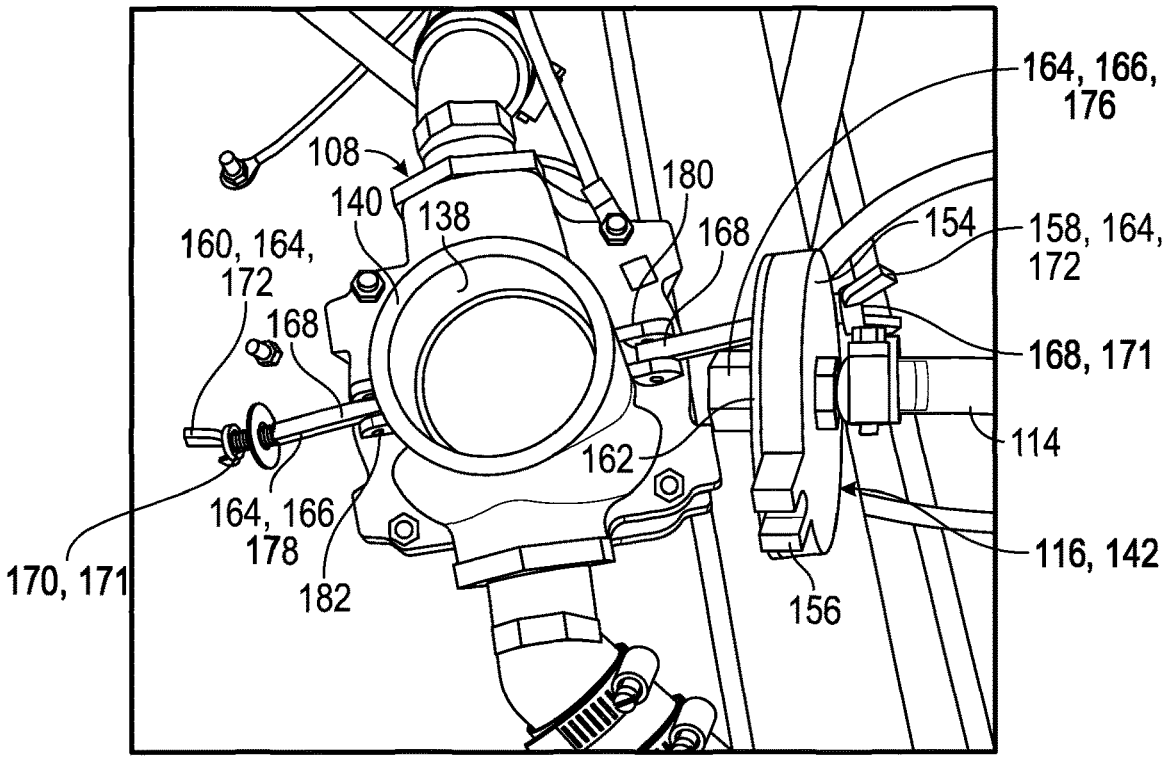
FIG. 5 is an enlarged perspective view of the cap assembly of the FIG. 4, illustrating the cap assembly removed from the sea strainer.
Figure 6:
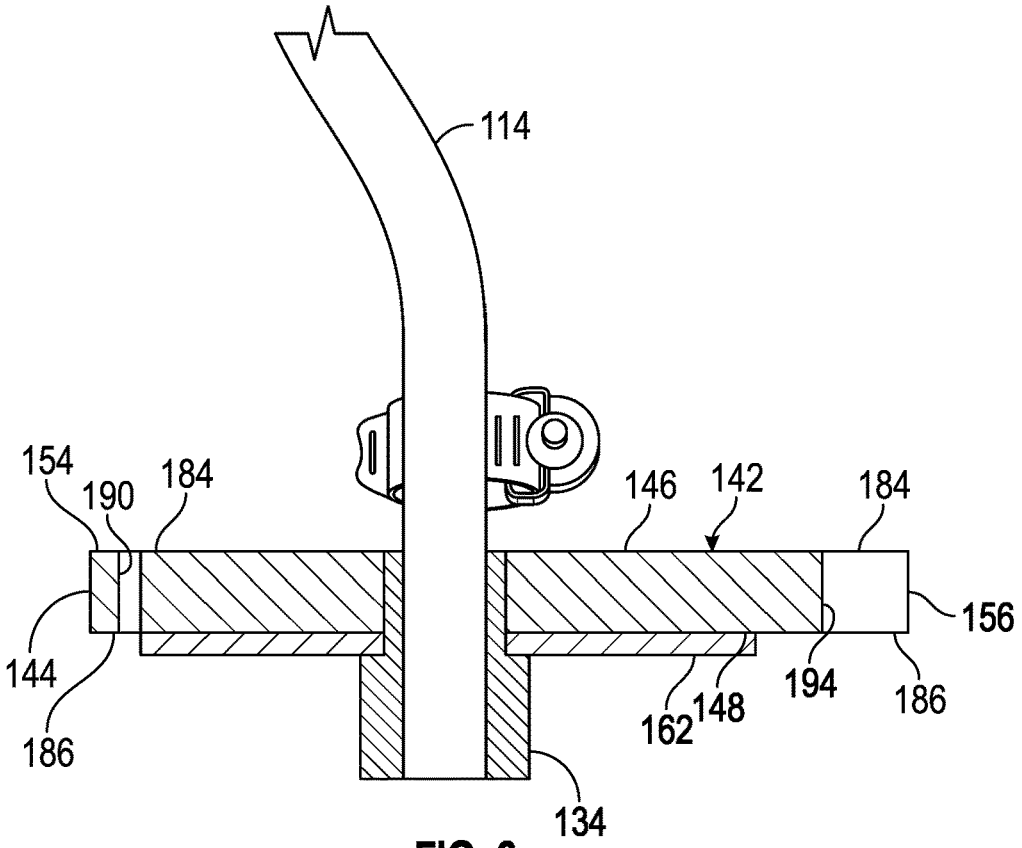
FIG. 6 is a side view of the cap assembly of FIG. 1, illustrating the cap assembly attached to an end of the conduit opposite to the container.
Figure 7:
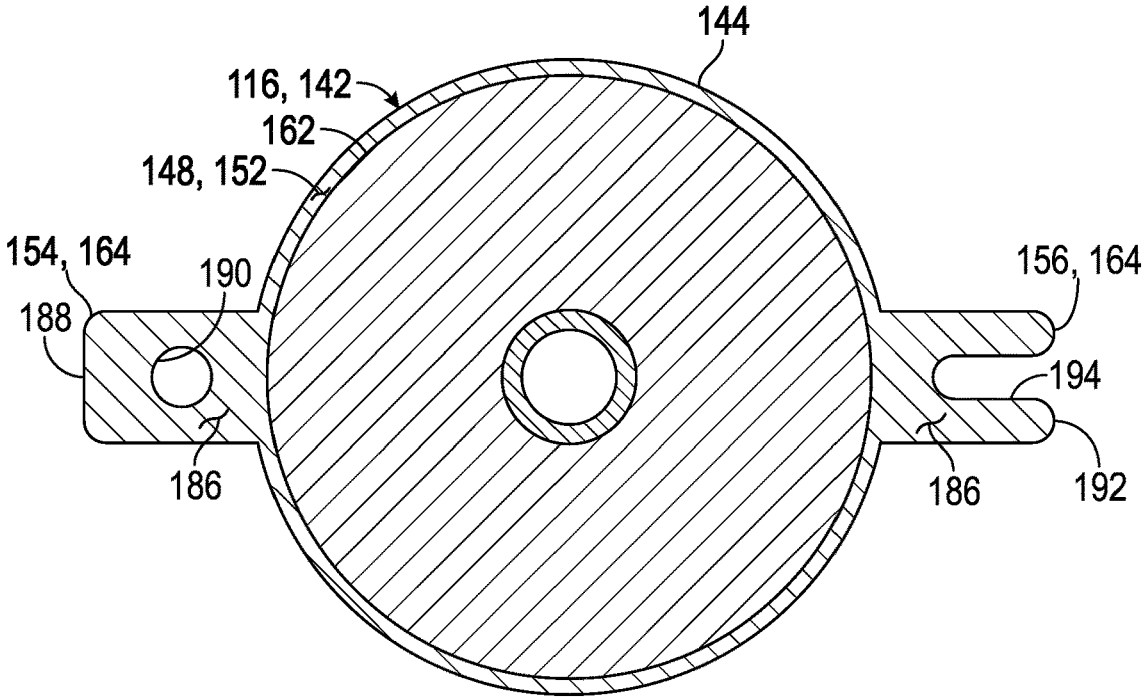
FIG. 7 is a top plan view of the cap assembly of FIG. 1.

Referring generally to FIGS. 1-7, the system 100 further includes a cap assembly 116 fluidly connecting the downstream end 134 of the conduit 114 to an inlet opening 138 (FIG. 5) defined by a top rim 140 of the sea strainer 108. As best shown in FIG. 6, the cap assembly 116 includes a lid 142 having a planar wall 144 with top and bottom surfaces 146, 148 and a thickness between the top and bottom surfaces 146, 148. The lid 142 defines a channel 150 extending between the top and bottom surfaces 146, 148, with the channel 150 receiving the downstream end 134 of the conduit 114, and the bottom surface 148 defining an annular surface area 154 (FIG. 7). The lid 142 further has first and second abutments 154, 156 (FIG. 7) extending radially outward from the planar wall 144, with first and second nuts 158, 160 (FIG. 4) engaging an associated one of the first and second abutments 154, 156. The cap assembly 116 further includes a seal 162 (FIGS. 6 and 7) attached to the annular surface area 154 of the lid 142. The seal 162 can be a ring made of resilient material, such as rubber. In other examples, the seal may be a series of interdigitated lands and grooves or other structures that prevents antifreeze from being spilled proximal to the sea strainer.

As shown in FIGS. 4 and 5, the cap assembly 116 further includes one or more fasteners 164 for attaching the lid 142 to the sea strainer 108, such that the seal 162 is sandwiched between the annular surface portion 152 of the lid 142 and the top rim 140 of the sea strainer 108. In this non-limiting example, the fasteners 164 include an elongated shaft 166 having a first end 168 pivotably attached to one of the lid 142 and the sea strainer 108. The elongated shaft 166 further includes a second end 170 with a threaded fastener 171. The fastener 164 further includes a nut 172 (e.g., nuts 158, 160) threadably attached to the threaded fastener 171 of the elongated shaft 166 and engaging the other of the lid 142 and the sea strainer 108, where the fastener 164 attaches the lid 142 to the sea strainer 108 in response to the nut 172 engaging the other of the lid 142 and the sea strainer 108.

More specifically, in this non-limiting example, the fastener 164 includes first and second elongated shafts 176, 178 pivotably attached to an associated one of first and second portions 180, 182 of the sea strainer 108. The fastener 164 further includes first and second nuts 158, 160 threadably attached to an associated one of the first and second elongated shafts 176, 178 and engaging the lid 142, where the fastener 164 attaches the lid 142 to the sea strainer 108, in response to the first and second nuts 158, 160 engaging the lid 142.

Also, in this non-limiting example, each of the first and second abutments 154, 156 has an upper surface 184 that is positioned coplanar with the top surface 146 of the planar wall 144 and a lower surface 186 that is positioned coplanar with the bottom surface 148 of the planar wall 144. The first and second abutments 154, 156 are disposed diametrically opposite to one another relative to the planar wall 144. The first abutment 154 defines a first peripheral edge 188, with the first abutment 154 further including a through hole 190 that is spaced from the first peripheral edge 188 and extending between the upper and lower surfaces 184, 186. The second abutment 156 defines a second peripheral edge 192 and an open-ended slot 194, with the open ended slot extending radially outward and terminating at the second peripheral edge 192, and the open-ended slot 194 further extending between the upper and lower surfaces 184, 186.

Figure 8:
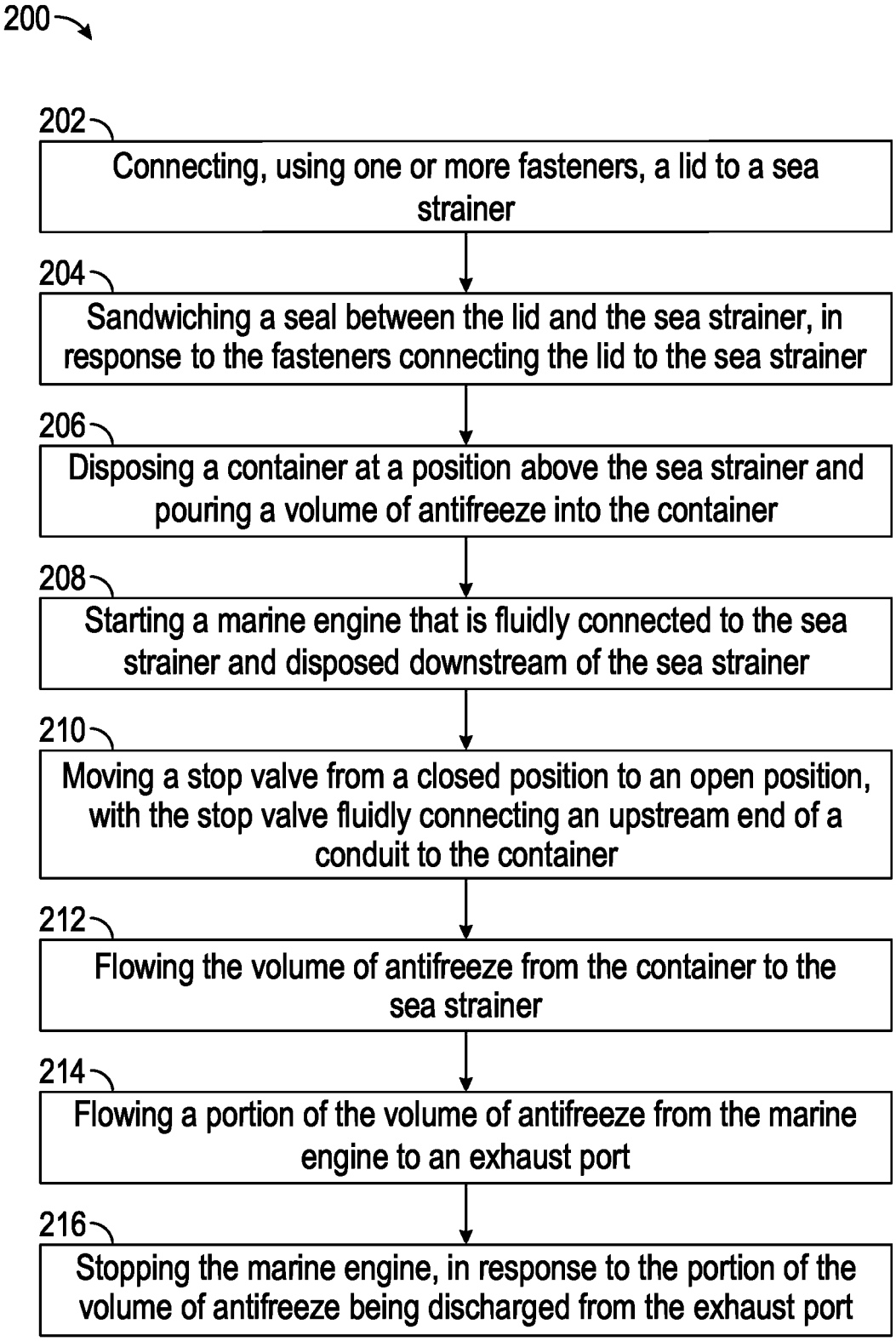
FIG. 8 is a flow chart of one example of a method of operating the antifreeze delivery system of FIG. 1.

Referring to FIG. 8, one non-limiting example of a method 200 for operating the system 100 of FIGS. 1-7 is illustrated. The method 200 begins at block 202 with connecting, using one or more of the fasteners 164, the lid 142 to the sea strainer 108. More specifically, in this non-limiting example, the method 200 includes pivotably attaching, using first and second elongated shafts 176, 178, to an associated one of first and second portions 180, 182 of the sea strainer 108. The method 200 further includes threadably attaching first and second nuts 158, 160 to an associated one of the first and second elongated shafts 176, 178 and engaging the lid 142. The fastener 164 attaches the lid 142 to the sea strainer 108, in response to the first and second nuts 158, 160 engaging the lid 142. In other examples, other suitable fasteners attached the lid to the sea strainer or other hydraulic circuit. The method 200 then proceeds to block 204.

At block 204, the method 200 includes sandwiching the seal 162 between the annular surface portion 152 of the lid 142 and a top rim 140 of the sea strainer 108, in response to the fastener connecting the lid 142 to the sea strainer 108. In this non-limiting examples, the seal 162 is a separate deformable material attached to the lid 142. In other non-limiting examples, the cap assembly may not include the seal, and the lid may have structures or be formed from deformable material that prevents antifreeze from flowing through an interface between the lid and the rim of the sea strainer. The method 200 includes fluidly connecting, using the lid 142, the downstream end of the conduit 114 to the inlet opening 138 defined by the top rim 140 of the sea strainer 108, with the lid 142 including the planar wall 144 having top and bottom surfaces 146, 148 and the thickness between the top and bottom surfaces 146, 148. The lid 142 defines the channel 150 extending between the top and bottom surfaces 146, 148, and the channel 150 receives the downstream end 134 of the conduit 114. The method 200 then proceeds to block 206.

At block 206, the method 200 further includes disposing the container 112 at a position above the sea strainer 108 and pouring the volume of the antifreeze in the container 112. In other non-limiting examples, where the system may include a pump that pumps antifreeze from the container to the sea strainer, the method may not include disposing the container at a position above the sea strainer. The method 200 then proceeds to block 208.

At block 208, the method 200 further includes starting the marine engine 106 that is fluidly connected to the sea strainer 108 and disposed downstream of the sea strainer 108. The method 200 then proceeds to block 210.

At block 210, the method 200 further includes moving the stop valve 136 from the closed position to the open position, with the stop valve 136 fluidly connecting the upstream end 132 of the conduit 114 to the annular wall 122 of the open-topped vessel 120. The method 200 then proceeds to block 212.

At block 212, the method 200 further includes flowing the volume of antifreeze from the chamber 118 of the container 112 to the sea strainer 108. In this non-limiting example, gravitational force draws the antifreeze from the container 112 to the sea strainer 108. In other non-limiting examples, where the system may include a pump fluidly connected to the container, the conduit, and/or the sea strainer, the pump may pump the antifreeze from the container to the sea strainer. The method 200 further includes flowing the volume of antifreeze from the sea strainer to the marine engine, in response to the antifreeze flowing from the container 112 to the sea strainer 108. The method 200 further includes flowing, using the one-way air relief valve 130 attached to the cover 126 of the container 112, air into the chamber 118 of the container 112 in response to the volume of antifreeze flowing from the chamber 118 of the container 112 to the sea strainer 108. The method 200 then proceeds to block 214.

At block 214, the method 200 further includes flowing a portion of the volume of antifreeze from the marine engine 106 to the exhaust port 110, which is fluidly connected to the marine engine and disposed downstream of the marine engine 106. The method 200 then proceeds to block 216.

At block 216, the method 200 further includes stopping the marine engine 106, in response to the portion of the volume of antifreeze being discharged from the exhaust port 110.

With regard to the media, processes, systems, methods, heuristics, etc. described herein, it should be understood that, although the steps of such processes, etc. have been described as occurring according to a certain ordered sequence, such processes may be practiced with the described steps performed in an order other than the order described herein. It further should be understood that certain steps may be performed simultaneously, that other steps may be added, or that certain steps described herein may be omitted. In other words, the descriptions of processes herein are provided for the purpose of illustrating certain embodiments and should in no way be construed so as to limit the claims.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their plain and ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An antifreeze delivery system comprising:

a container defining a chamber for containing a volume of an antifreeze;

a conduit having an upstream end and a downstream end, with the upstream end being fluidly connected to the container and receiving the volume of the antifreeze from the container; and a cap assembly fluidly connecting the downstream end of the conduit to an inlet opening defined by a top rim of a sea strainer, with the cap assembly comprising:

a lid including a planar wall with top and bottom surfaces and a thickness between the top and bottom surfaces, and the lid defines a channel extending between the top and bottom surfaces, with the channel receiving the downstream end of the conduit, and the bottom surface defining an annular surface area;

a seal attached to the annular surface area of the lid; and at least one fastener for attaching the lid to the sea strainer such that the seal is sandwiched between the annular surface portion of the lid and the top rim of the sea strainer, wherein the at least one fastener comprises:

first and second elongated shafts pivotably attached to an associated one of first and second portions of the sea strainer; and first and second nuts that are threadably attached to an associated one of the first and second elongated shafts and engage the lid, where the at least one fastener attaches the lid to the sea strainer in response to the first and second nuts engaging the lid, wherein the lid comprises first and second abutments extending radially outward from the planar wall, with the first and second nuts engaging an associated one of the first and second abutments, wherein each of the first and second abutments has an upper surface that is positioned coplanar with the top surface of the planar wall and a lower surface that is positioned coplanar with the bottom surface of the planar wall, wherein the first and second abutments are disposed diametrically opposite to one another relative to the planar wall, wherein the second abutment defines a second peripheral edge and an open-ended slot, with the open ended slot extending radially outward and terminating at the second peripheral edge, and the open-ended slot further extending between the upper and lower surfaces, wherein the container comprises an open-topped vessel having an annular wall defining the chamber, with the upstream end of the conduit being fluidly connected to the annular wall of the open-topped vessel via a stop valve that is movable between an open position and a closed position, wherein the annular wall terminates at an upper rim, and the container further comprises a cover releasably attached to the upper rim, and wherein the cover defines an aperture, and the container further comprises a one-way air relief valve attached to the cover and disposed in the aperture, such that air flows through the one-way air relief valve into the chamber in response to the antifreeze being drawn from the chamber and into the upstream end of the conduit.

2. The antifreeze delivery system of claim 1 wherein the first abutment defines a first peripheral edge, the first abutment further including a through hole that is spaced from the first peripheral edge and extending between the upper and lower surfaces.

3. A cap assembly for an antifreeze delivery system having a container defining a chamber for containing a volume of an antifreeze, and the antifreeze delivery system further including a conduit having an upstream end and a downstream end, with the upstream end being fluidly connected to the container to receive the volume of the antifreeze from the container, the cap assembly comprising:

a lid fluidly connecting the downstream end of the conduit to an inlet opening defined by a top rim of a sea strainer, with the lid including a planar wall with top and bottom surfaces and a thickness between the top and bottom surfaces, and the lid defines a channel extending between the top and bottom surfaces, with the channel receiving the downstream end of the conduit, and the bottom surface defining an annular surface area;

a seal attached to the annular surface area of the lid; and at least one fastener for attaching the lid to the sea strainer such that the seal is sandwiched between the annular surface portion of the lid and the top rim of the sea strainer, wherein the at least one fastener comprises:

first and second elongated shafts pivotably attached to an associated one of first and second portions of the sea strainer; and first and second nuts threadably attached to an associated one of the first and second elongated shafts and engaging the lid, where the at least one fastener attaches the lid to the sea strainer in response to the first and second nuts engaging the lid;

wherein the lid comprises first and second abutments extending radially outward from the planar wall, with the first and second nuts engaging an associated one of the first and second abutments, wherein each of the first and second abutments has an upper surface that is positioned coplanar with the top surface of the planar wall and a lower surface that is positioned coplanar with the bottom surface of the planar wall, and the first and second abutments are disposed diametrically opposite to one another relative to the planar wall, wherein the first abutment defines a first peripheral edge, the first abutment further including a through hole that is spaced from the first peripheral edge and extending between the upper and lower surfaces, and the second abutment defines a second peripheral edge and an open-ended slot, with the open ended slot extending radially outward and terminating at the second peripheral edge, with the open-ended slot further extending between the upper and lower surfaces, wherein the container comprises an open-topped vessel having an annular wall defining the chamber, with the upstream end of the conduit being fluidly connected to the annular wall of the open-topped vessel via a stop valve movable between an open position and a closed position, and wherein the annular wall terminates at an upper rim, and the container further comprises a cover releasably attached to the upper rim and defining an aperture, with the container further comprising a one-way air relief valve attached to the cover and disposed in the aperture, such that air flows through the one-way air relief valve into the chamber in response to the antifreeze being drawn from the chamber and into the upstream end of the conduit.

4. A method of operating a cap assembly for an antifreeze delivery system having a container defining a chamber for containing a volume of an antifreeze, and the antifreeze delivery system further including a conduit having an upstream end and a downstream end, with the upstream end being fluidly connected to the container to receive the volume of the antifreeze from the container, the method comprising:

connecting, using at least one fastener, the lid to the sea strainer;

sandwiching the seal between an annular surface portion of the lid and a top rim of the sea strainer in response to the at least one fastener connecting the lid to the sea strainer;

fluidly connecting, using a lid, the downstream end of the conduit to an inlet opening defined by the top rim of the sea strainer, with the lid including a planar wall having top and bottom surfaces and a thickness between the top and bottom surfaces, and the lid defining a channel that extends between the top and bottom surfaces, and the channel receiving the downstream end of the conduit;

disposing the container at a position above the sea strainer;

pouring a volume of the antifreeze in the container;

starting a marine engine fluidly connected to the sea strainer and disposed downstream of the sea strainer;

moving a stop valve from a closed position to an open position, with the stop valve fluidly connecting the upstream end of the conduit to the annular wall of the open-topped vessel;

flowing the volume of antifreeze from the chamber of the container to the sea strainer;

flowing the volume of antifreeze from the sea strainer to the marine engine;

flowing a portion of the volume of antifreeze from the marine engine to an exhaust port fluidly connected to the marine engine and disposed downstream of the marine engine; and stopping the marine engine in response to the portion of the volume of antifreeze being discharged from the exhaust port.

5. The method of claim 4 further comprising flowing, using a one-way air valve attached to a cover of the container, air into the chamber of the container in response to the volume of antifreeze flowing from the chamber of the container to the sea strainer.

6. A cap assembly for an antifreeze delivery system having a container defining a chamber for containing a volume of an antifreeze, and the antifreeze delivery system further including a conduit having an upstream end and a downstream end, with the upstream end being fluidly connected to the container to receive the volume of the antifreeze from the container, the cap assembly comprising:

a lid fluidly connecting the downstream end of the conduit to an inlet opening defined by a top rim of a sea strainer, with the lid including a planar wall with top and bottom surfaces and a thickness between the top and bottom surfaces, and the lid defines a channel extending between the top and bottom surfaces, with the channel receiving the downstream end of the conduit, and the bottom surface defining an annular surface area, the downstream end abutting the top surface and extending through the channel past the bottom surface;

a seal attached to and extending across the annular surface area of the bottom surface of the lid, the downstream end extending through and past the seal; and at least one fastener for attaching the lid to the sea strainer such that the seal is sandwiched between the annular surface portion of the lid and the top rim of the sea strainer.

* * * * *